US007173401B1

(12) United States Patent
Huang

(10) Patent No.: US 7,173,401 B1
(45) Date of Patent: Feb. 6, 2007

(54) DIFFERENTIAL AMPLIFIER AND LOW DROP-OUT REGULATOR WITH THEREOF

(75) Inventor: Chun-Sheng Huang, Huwei Township, Yunlin County (TW)

(73) Assignee: Integrated System Solution Corp., Hsinchu (TW)

( * ) Notice: Subject to any disclaimer, the term of this patent is extended or adjusted under 35 U.S.C. 154(b) by 31 days.

(21) Appl. No.: 11/195,263

(22) Filed: Aug. 1, 2005

(51) Int. Cl.
*G05F 1/573* (2006.01)

(52) U.S. Cl. ..... 323/277; 323/273; 323/274; 327/541

(58) Field of Classification Search ..... 327/277, 327/540, 541, 543; 323/316, 273, 280
See application file for complete search history.

(56) References Cited

U.S. PATENT DOCUMENTS 6,188,211 B1 2/2001 Rincon-Mora et al. ..... 323/280
6,522,111 B2 * 2/2003 Zadeh et al. ..... 323/277
6,765,374 B1 7/2004 Yang et al. ..... 323/273
7,002,401 B2 * 2/2006 Khalid ..... 327/541

* cited by examiner

*Primary Examiner*—Daniel Swerdlow
*Assistant Examiner*—Juan White
(74) *Attorney, Agent, or Firm*—J.C. Patents

(57) ABSTRACT

A differential amplifier having a positive input terminal, a negative input terminal, an output terminal, a bias terminal and a ground terminal is provided. The differential amplifier comprises a differential pair circuit and a current mirror circuit. Wherein, the differential pair circuit is coupled to the positive input terminal, the negative input terminal, the output terminal, and the bias terminal of the differential amplifier. The current mirror circuit receives a constant current from a current source, and mirrors the constant current to the differential pair circuit. The current mirror circuit further connects to the ground terminal of the differential amplifier, and the terminal of the current mirror circuit receiving the constant current is coupled to a first source/drain terminal of a first PMOS transistor. A second source/drain and a gate of the first PMOS transistor are connected to the bias terminal and the output terminal of the differential amplifier, respectively.

7 Claims, 2 Drawing Sheets

DIFFERENTIAL AMPLIFIER AND LOW DROP-OUT REGULATOR WITH THEREOF

BACKGROUND OF THE INVENTION

1. Field of the Invention

The present invention relates to a differential amplifier, and more particularly, to a differential amplifier capable of providing a larger range of output current.

2. Description of the Related Art

Figure 1:
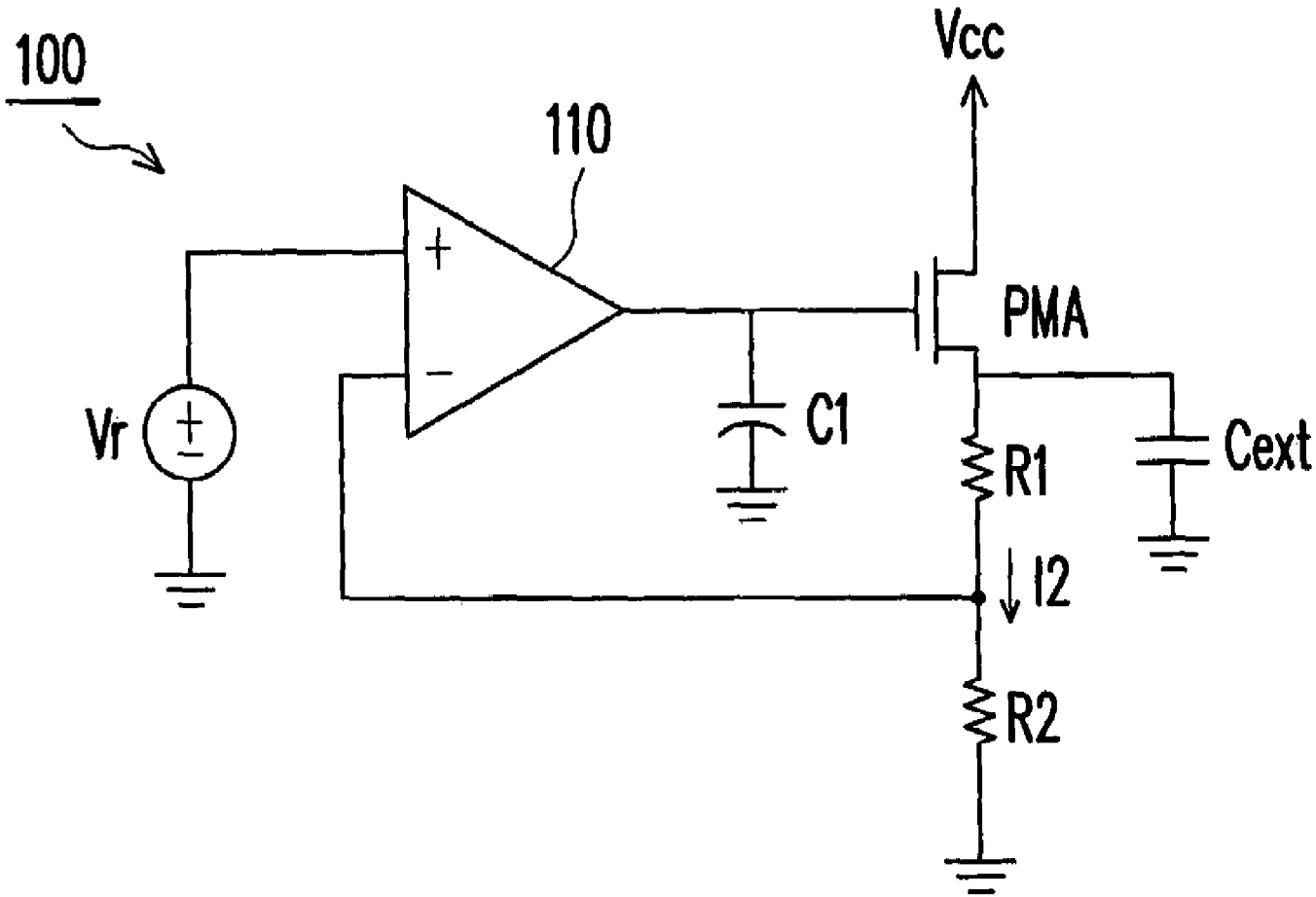
FIG. 1 (RELATED ART)

FIG. 1 schematically shows a circuit diagram of a conventional low drop-out (LDO) regulator. Referring to FIG. 1, the LDO regulator 100 comprises a differential amplifier 110, and an output terminal of the differential amplifier 110 is electrically coupled to a gate of a PMOS transistor PMA. A first source/drain terminal of the PMOS transistor PMA is grounded through the resistors R1 and R2 that are serially connected. In addition, the first source/drain terminal of the PMOS transistor PMA is grounded through an external capacitor Cext, and a second source/drain terminal of the PMOS transistor PMA is electrically coupled to a DC bias Vcc. Moreover, a parasitic capacitor C1 is between the output terminal of the differential amplifier 110 and the gate of the PMOS transistor PMA.

Referring to FIG. 1, the differential amplifier 110 further comprises a positive input terminal and a negative input terminal. Wherein, the positive input terminal of the differential amplifier 110 is grounded through an input voltage source Vr, and the negative terminal of the differential amplifier 110 is electrically coupled to a node where the resistors R1 and R2 are joined to form a negative feedback circuit.

In the LDO regulator 100, the external capacitor Cext causes a dominant pole of the frequency response when cooperated with the output impedances of the PMOS transistor PMA and the resistors R1 and R2, and causes a non-dominant pole when cooperated with the output impedance of the differential amplifier 110. In addition, in the frequency response of the LDO regulator 100, the dominant pole is occurred before the non-dominant pole.

The output impedance of the PMOS transistor PMA is inversely proportional to the load current $I_L$ of the PMOS transistor PMA. In other words, the output impedance of the PMOS transistor PMA decreases with the increase of the load current $I_L$, one that pushes the dominant pole move toward to the high frequency zone, such that the dominant pole is very close to the non-dominant pole. Meanwhile, the phase margin of the LDO regulator 100 may be too small, thus the system stability is significantly impacted. Accordingly, in order not to impact the system stability, the variance of the current outputted from the LDO regulator 100 should not be too big. Consequently, the application of the LDO regulator 100 is extremely restricted.

U.S. Pat. No. 6,188,211 discloses "Current-Efficient Low-Drop-Out Voltage Regulator with Improved Load Regulation and Frequency Response" (Rinco-Mora, et al.). In this patent, a source follower circuit is disposed on the output terminal of the differential amplifier. With such design, the low drop-out regulator provided by U.S. Pat. No. 6,188,211 uses appropriate current bias to compensate the frequency response so as to increase the range of the output current. However, since it is required to dispose a source follower between the operational differential amplifier and the load in U.S. Pat. No. 6,188,211, although it resolves the problem of system instability under large current operation, it is not easy to operate under a small current environment.

SUMMARY OF THE INVENTION

Therefore, it is an object of the present invention to provide a differential amplifier whose output resistance is increased with the increase of the output current, such that the frequency of the non-dominant pole can move toward the high frequency zone.

It is another object of the present invention to provide a low drop-out regulator capable of providing a larger range of the output current.

A low drop-out regulator provided by the present invention comprises a differential amplifier. Wherein, the differential amplifier has a positive input terminal, a negative input terminal, an output terminal, a bias terminal and a ground terminal. In the present invention, the differential amplifier is mainly composed of a differential pair circuit and a current mirror circuit. Wherein, the differential pair circuit electrically coupled to the negative input terminal and the output terminal of the differential amplifier, receives an input voltage from the positive input terminal and connects to a positive bias through the bias terminal. The current mirror circuit receiving a constant current from a current source mirrors the constant current to the differential pair circuit and connects to the ground through the ground terminal of the differential amplifier. In addition, the terminal of the current mirror circuit receiving the constant current connects to a first source/drain terminal of a first PMOS transistor, and a second source/drain terminal and a gate of the first PMOS transistor are electrically coupled to the positive bias mentioned above and the output terminal of the differential amplifier respectively. Moreover, the output terminal of the differential amplifier further connects to a gate terminal of a second PMOS transistor. Furthermore, a first source/drain terminal of the second PMOS transistor is grounded through a first passive element and a second passive element that are serially connected, and a second source/drain terminal of the second PMOS transistor is electrically coupled to the positive bias mentioned above.

Since the gate of the first PMOS transistor is electrically coupled to the gate of the second PMOS transistor through the output terminal of the differential amplifier, therefore, when the load current passing through the second PMOS transistor increases, the gate of the first PMOS transistor pushes and increases the current passing through the differential pair circuit. Meanwhile, the output resistance of the differential amplifier is decreased, which makes the non-dominant pole move toward the high frequency zone. Accordingly, when the load current is changed, since the narrowing speed of the phase margin is lowered down, the range of the output current is increased.

BRIEF DESCRIPTION DRAWINGS

The accompanying drawings are included to provide a further understanding of the invention, and are incorporated in and constitute a part of this specification. The drawings illustrate embodiments of the invention, and together with the description, serve to explain the principles of the invention.

FIG. 1 schematically shows a circuit diagram of a conventional low drop-out regulator.

Figure 2:
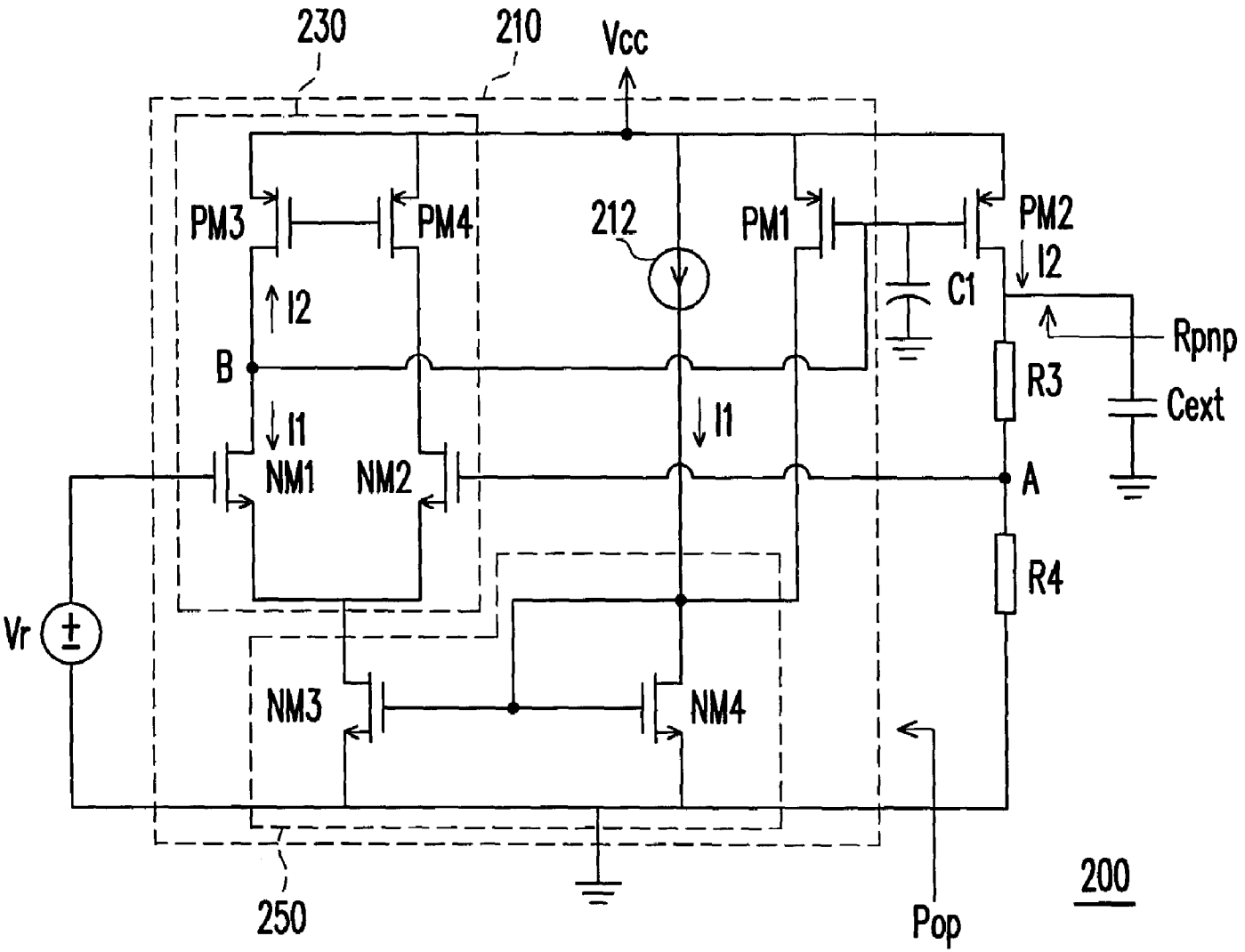

FIG. 2 schematically shows a circuit diagram of a low drop-out regulator according to a preferred embodiment of the present invention.

DESCRIPTION PREFERRED EMBODIMENTS

FIG. 2 schematically shows a circuit diagram of a low drop-out regulator according to a preferred embodiment of the present invention. Referring to FIG. 2, in the low drop-out regulator 200, the differential amplifier circuit 210 has a positive input terminal, a negative input terminal, an output terminal, a bias terminal and a ground terminal. Wherein, the bias terminal of the differential amplifier circuit 210 is electrically coupled to a positive bias Vcc, and its ground terminal is grounded. The output terminal of the differential amplifier circuit 210 is electrically coupled to a gate of a PMOS transistor PM2; a first source/drain terminal of the PMOS transistor PM2 serially connects to the passive elements such as the resistors R3 and R4, and its second source/drain terminal is electrically coupled to the positive bias Vcc. As shown in FIG. 2, a first terminal of the resistor R3 is electrically coupled to the first source/drain terminal of the PMOS transistor PM2, and its second terminal is electrically coupled to a first terminal of the resistor R4. The second terminal of the resistor R4 is grounded and electrically coupled to the positive input terminal of the differential amplifier circuit 210 through an input voltage source Vr.

In the preferred embodiment of the present invention, a parasitic capacitor C1 is between the output terminal of the differential amplifier circuit 210 and the gate of the PMOS transistor PM2.

In the differential amplifier circuit 210, a differential pair circuit 230 is electrically coupled to the positive input terminal, the negative input terminal, the output terminal, and the bias terminal of the differential amplifier circuit 210. In addition, the differential pair circuit 230 further connects to a current mirror circuit 250. Wherein, the current mirror circuit 250 receives a constant current I from a current source 212, and mirrors the constant current I to the differential pair circuit 230. The input terminal of the differential amplifier circuit 210 further connects to a gate of the PMOS transistor PM1, and a first source/drain terminal of the PMOS transistor PM1 is electrically coupled to a terminal receiving the constant current I of the current mirror circuit 250. In addition, a second source/drain terminal of the PMOS transistor PM1 is electrically coupled to a positive bias Vcc through the bias terminal.

The differential pair circuit 230 further comprises two NMOS transistors NM1 and NM2. Wherein, a gate of the NMOS transistor NM1 is electrically coupled to the positive input terminal of the differential amplifier circuit 210, and its first source/drain terminal is electrically coupled to a first source/drain terminal of the NMOS transistor NM2. A gate of the NMOS transistor NM2 electrically coupled to the negative input terminal of the differential amplifier circuit 210 connects to a node A where the resistors R3 and R4 are joined through the negative input terminal to form a negative feedback circuit.

In addition, the differential pair circuit 230 further comprises two PMOS transistors PM3 and PM4. Wherein, the first source/drain terminals of the PMOS transistors PM3 and PM4 are respectively connect to the second source/drain terminals of the NMOS transistors NM1 and NM2, and the first source/drain terminal of the PMOS transistor PM3 further connects to the output terminal of the differential amplifier circuit 210. Moreover, the gate terminals and the second source/drain terminals of the PMOS transistors PM3 and PM4 are respectively connected with each other.

In the present embodiment, the current mirror circuit 250 may comprise two NMOS transistors NM3 and NM4. Wherein, a first source/drain terminal of the NMOS transistor NM3 connects to the ground through the ground terminal of the differential amplifier circuit 210, and its second source/drain terminal is electrically coupled to the first source/drain terminal of the NMOS transistor NM1 in the differential pair circuit 230. Similar to the NMOS transistor NM3, a first source/drain terminal of the NMOS transistor NM4 connects to the ground through the ground terminal of the differential amplifier circuit 210, and a second source/drain terminal and a gate electrically coupled with each other jointly connect to the gate of the NMOS transistor NM3. In addition, a second source/drain terminal of the NMOS transistor NM4 receiving the constant current I from the current source 212 further connects to the first source/drain terminal of the PMOS transistor PM1.

Referring to FIG. 2, in the low drop-out regulator 200, the frequency $f_{P1}$ of the dominant pole is represented by the following equation:

$$f_{P1} = \frac{1}{2\pi R_{pnp} C_{ext}} \tag{1}$$

and the frequency $f_{P2}$ of the non-dominant pole is represented by the following equation:

$$f_{P2} = \frac{1}{2\pi R_{op} C1} \tag{2}$$

where $R_{pnp}$ and $R_{op}$ represent the output resistances of the PMOS transistor and the differential amplifier circuit 210 respectively, and Cext is the external capacitor.

Since the output resistance $R_{pnp}$ of the PMOS transistor PM2 is inversely proportional to the load current $I_L$ passing through the PMOS transistor PM2, therefore, when the load current $I_L$ increases, the output resistance $R_{pnp}$ of the PMOS transistor PM2 is decreased accordingly. Referring to equation (1), the dominant pole in the frequency response of the low drop-out regulator 200 will move toward the high frequency zone.

Meanwhile, since the gate of the PMOS transistor PM1 and the gate of the PMOS transistor PM2 are electrically coupled with each other, when the load current $I_L$ increases, the PMOS transistor PM1 mirrors the variance of the load current $I_L$ to the node B with a very high falling speed, such that both of the working current I1 passing through the NMOS transistor NM1 and the working current I2 passing through the PMOS transistor PM3 are increased. However, the working currents I1 and I2 are proportionally lower than the load current $I_L$. Accordingly, the impedances of the NMOS transistor NM1 and the PMOS transistor PM3 are decreased, such that the output resistance $R_{op}$ of the differential amplifier circuit 210 is further decreased. Referring to equation (2), the non-dominant pole of the low drop-out regulator 200 also moves toward the high frequency zone, such that the narrowing speed of phase margin reduction is slowed down.

Although the invention has been described with reference to a particular embodiment thereof, it will be apparent to one of the ordinary skill in the art that modifications to the described embodiment may be made without departing from the spirit of the invention. Accordingly, the scope of the invention will be defined by the attached claims not by the above detailed description.

What is claimed is:

1. A low drop-out (LDO) regulator, comprising:

a differential amplifier circuit having a positive input terminal, a negative input terminal, an output terminal, a bias terminal and a ground terminal, comprising:

a differential pair circuit electrically coupled to the negative input terminal and the output terminal, receiving an input voltage from the positive input terminal, and electrically coupled to a positive bias through the bias terminal;

a current source for providing a constant current;

a current mirror circuit for receiving the constant current and mirroring the constant current to the differential pair circuit, and the current mirror circuit being grounded through the ground terminal; and a first PMOS transistor having a first source/drain terminal electrically coupled to the current mirror circuit for receiving the constant current, a second source/drain terminal electrically coupled to the positive bias through the bias terminal, and a gate electrically coupled to the output terminal;

a first passive element having a first terminal being grounded, and a second terminal electrically coupled to the negative input terminal; and a second PMOS transistor having a first source/drain terminal electrically coupled to the negative input terminal and the second terminal of the first passive element, a gate electrically coupled to the output terminal, and a second source/drain terminal electrically coupled to the positive bias.

2. The low drop-out regulator of claim 1, wherein the differential pair circuit comprises:

a first NMOS transistor having a first source/drain terminal electrically coupled to the current mirror circuit for receiving the constant current mirrored by the current mirror circuit, a gate electrically coupled to the positive input terminal, and a second source/drain terminal electrically coupled to the output terminal;

a second NMOS transistor having a gate electrically coupled to the negative input terminal, and a first source/drain terminal electrically coupled to the first source/drain terminal of the first NMOS transistor;

a third PMOS transistor having a first source/drain terminal electrically coupled to the second source/drain terminal of the first NMOS transistor, and a second source/drain terminal electrically coupled to the positive bias through the bias terminal; and a fourth PMOS transistor having a first source/drain terminal electrically coupled to a gate thereof, a second source/drain terminal of the second NMOS transistor, and a gate of the third PMOS transistor respectively, and a second source/drain terminal electrically coupled to the positive bias through the bias terminal.

3. The low drop-out regulator of claim 1, wherein the current mirror circuit comprises:

a third NMOS transistor having a first source/drain terminal being grounded through the ground terminal, and a second source/drain terminal electrically coupled to the differential pair circuit; and a fourth NMOS transistor having a first source/drain terminal being grounded, a second source/drain terminal receiving the constant current, and a gate electrically coupled to the gate of the third NMOS transistor.

4. The low drop-out regulator of claim 1, wherein a parasitic capacitor is connected between the output terminal of the differential amplifier circuit and the second PMOS transistor.

5. The low drop-out regulator of claim 1, wherein the first passive element is a resistor.

6. The low drop-out regulator of claim 1, further comprising a second passive element having a first terminal electrically coupled to the negative input terminal and the second terminal of the first passive element, and a second terminal electrically coupled to the first source/drain terminal of the second PMOS transistor.

7. The low drop-out regulator of claim 6, wherein the second passive element is a resistor.

* * * * *